United States Patent [19]

Tibay

[11] 4,037,709

[45] July 26, 1977

[54] RIBBON SPOOL WITH BUILT-IN BIFACIAL RE-INKER

[76] Inventor: Eulogio Camacho Tibay, 1486 Castillo Park Subdivision, Almanza, Las Pinas, Rizal, Philippines

[21] Appl. No.: 610,350

[22] Filed: Sept. 4, 1975

[30] Foreign Application Priority Data

Sept. 4, 1974 Philippines ..... 16242

[51] Int. Cl.[2] ..... B41J 31/14

[52] U.S. Cl. ..... 197/171; 197/175

[58] Field of Search ..... 197/171, 175

[56] References Cited

U.S. PATENT DOCUMENTS

| | | | |
|---|---|---|---|
| 1,366,802 | 1/1921 | Hodge | 197/171 |
| 1,927,118 | 9/1933 | George | 197/6.7 |
| 1,953,881 | 4/1934 | Hanable | 197/171 |
| 1,962,309 | 6/1934 | Jewell | 197/171 |
| 2,038,706 | 4/1936 | Beckman | 197/171 |
| 2,760,464 | 8/1956 | Roggenburger | 197/171 |
| 3,209,725 | 10/1965 | Besenick | 197/171 |
| 3,918,569 | 11/1975 | Parker | 197/171 |

FOREIGN PATENT DOCUMENTS

| | | | |
|---|---|---|---|
| 732,749 | 3/1943 | Germany | 197/171 |
| 547,815 | 9/1942 | United Kingdom | 197/171 |

*Primary Examiner*—Edgar S. Burr
*Assistant Examiner*—William Pieprz
*Attorney, Agent, or Firm*—Sughrue, Rothwell, Mion, Zinn and Macpeak

[57] ABSTRACT

This invention relates generally to ribbon spools for typewritten machines and more particularly to a ribbon spool which is provided with a built-in bifacial re-inker adapted to contact the opposite edges of a ribbon wound thereon.

1 Claim, 3 Drawing Figures

FIG. 1
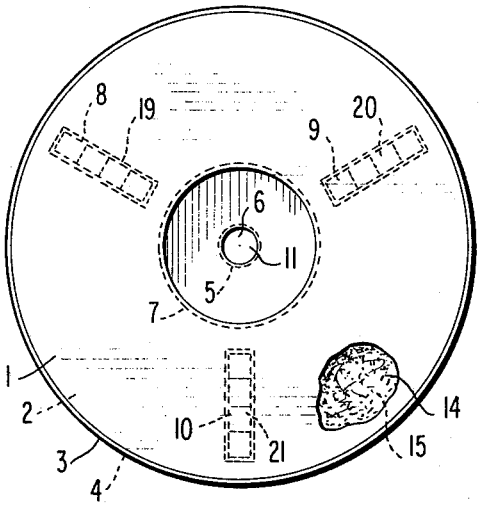
FIG. 3
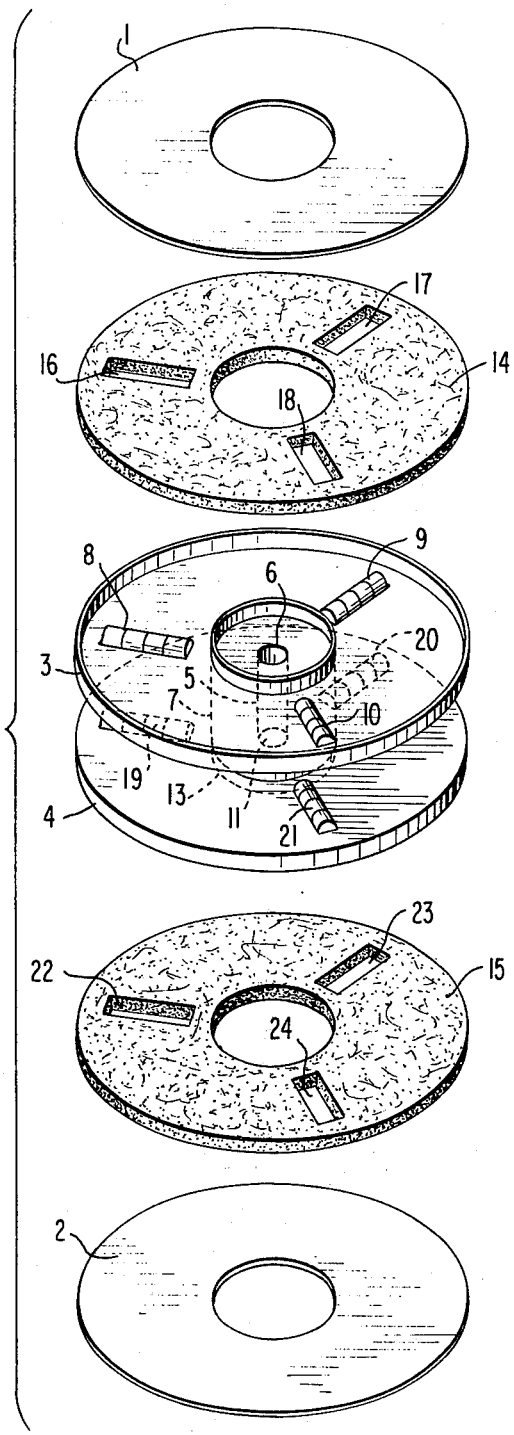
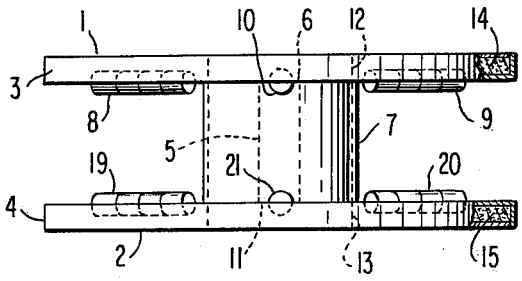
FIG. 2

RIBBON SPOOL WITH BUILT-IN BIFACIAL RE-INKER

BACKGROUND OF THE INVENTION

It is a known fact that the usefulness of a typewriter ribbon is usually terminated due to loss of ink supply and rarely, due to the deterioration of the ribbon fabric. As such, a ribbon exhausted with ink is merely thrown away. Attempts have been made to a re-ink typewriter ribbons separately from the ribbon spool or while in use on a typewriter but said re-inkers are too complicated, very costly, laborious and time-consuming to fabricate, most especially on a black and red ink combination. Furthermore, in said known devices, the ink is not uniformly transferred on the entire length of the inkribbon thereby causing over-inking on portions of the ribbon. In our gadget for a ribbon re-inker which is described in U.S. Pat. No. 3,951,253, issued on Apr. 20, 1976, the uniformity of ink transferred from the ink reservoirs to the exhausted ribbon was quite successful. However, due to the construction of said gadget, the adaption or adjustment to fit on top of existing ribbon spool is quite cumbersome. Furthermore, any accidental leakage on any portion thereof would limit the constant supply of ink form the ink vessel to the typewriter ribbon.

SUMMARY OF THE INVENTION

It is therefore, the main object of this invention to provide a typewriter ribbon spool with a bifacial re-inker which is free from the foregoing objections and which will distribute ink automatically and uniformly to the entire length of the ribbon in just the right amount and the flow of ink will occur only when the typewriter machine is operating.

Another object of the invention is to provide a ribbon spool with built-in re-inker wherein loss of ink on the ribbon wound thereon is readily re-filled by capillary action on the fabric of the ribbon thereby prolonging the life of the ribbon up to extent of the life of the ribbon fabric.

A still another object of the invention is to provide a ribbon spool with a built-in-re-inker which is very simple and compact and is installed to a typewriting machine just like as a standard ribbon spool.

Other objects of the invention are economy in construction; cheap in cost as it could be of a throw-away type; refillable; dependability and effectiveness in its use as a re-inker.

These and other objects of the invention will become apparent upon the reading of the detailed description taken in conjunction with the accompanying drawings, wherein:

BRIEF DESCRIPTION OF THE DRAWINGS

FIG. 1 is a top plan view of a ribbon spool with built-in bifacial re-inker embodying the present invention;

FIG. 2 is a front elevation view of FIG. 1; and

FIG. 3 is an exploded perspective view of FIG. 1.

DESCRIPTION OF THE PREFERRED EMBODIMENT

Referring now to the drawings in detail, the ribbon spool with built-in bifacial re-inker consists basically of identical upper and lower fenders 3 and 4, respectively, both of which are parallely disposed with respect to each other and fixedly secured to a ribbon holder 7 centrally thereof.

As clearly shown in FIG. 3, said ribbon spool 7 slightly extends through said identical upper and lower fenders 3 and 4, respectively, to define the respective identical circumferential projections 12 and 13. Provided centrally thereof is a cylindrical post 5 having holes 6 and 11 extending therethrough.

The identical upper fender 3 and the lower fender 4 are each provided with a plurality of segment rollers 8, 9, 10 and segment rollers 19, 20, 21 respectively, which rollers are rotatably mounted on complemental elongated slots disposed trisectionally thereon.

The mounting of each of said rollers on the respective slots is such that said rollers slightly protrude therefrom to be in rolling contact with the edge of the ribbon (not shown) being wound on said ribbon holder 7.

The outer surface of said fenders are each provided with a circumferential lip portion to define an ink vessel wherein identical inking felt pads 14 and 15 are respectively received therein. Each of said inking felt pads is provided with a hole to fit on the respective projections 12 and 13 and the elongated slots 16, 17, 18 and the slots 22, 23, 24 are trisectionally disposed in alignment with the rollers, 8, 9, 10 and rollers 19, 20, 21, respectively.

The felt pads 14, 15 are concealed within the confines of the respective fenders 3 and 4 by providing thereon a top cover 1 and a bottom cover 2, respectively. It is, however, be understood that before said felt pads are assembled and concealed in the respective fenders, said felt pads are soaked with the desired color of ribbon ink. The lower felt pad 15 could be of red ink or both inking pads could be of black ribbon ink.

In operation, a ribbon (not shown) is wound in the ribbon holder 7 and the upper and lower edges of said ribbon is in rolling contact with the respective upper segment rollers 8, 9, 10 and rollers 19, 20, 21. The ink from the respective pads is then transferred by capillary action to the opposite edges of the ribbon by the use of the rollers during the winding and unwinding of said ribbon.

While I have shown and described a specific embodiment of my invention, it will be readily apparent that many minor changes of structure and operation could be made without departing from the spirit of the invention.

I claim:

1. In a ribbon spool having a ribbon holder for holding ribbon wound thereon; a pair of fenders secured at the ends of said ribbon holder, said fenders each having faces disposed inwardly towards a ribbon wound on said holder, the improvement comprising: re-inker means provided on each of said fenders, said re-inker means having rollers rotatably mounted in each fender and slightly protruding at the inner faces thereof, an inking felt pad sealingly mounted in each of said fenders and said rollers comprising a series of segmented rollers rotatably supported in said fenders in communication with said felt pads, said rollers being positioned trisectionally on said fenders whereby ink from said inking pads is transferred to the edges of a ribbon wound on said ribbon holder in contact with said rollers during rotation of said spool which effectuates the winding and unwinding thereof to uniformly transfer ink to said ribbon by capillary action.

* * * * *